US008528485B2

(12) United States Patent
Moritzhuber

(10) Patent No.: US 8,528,485 B2
(45) Date of Patent: Sep. 10, 2013

(54) CABLEWAY SYSTEM FOR CONVEYING SKIERS AND ILLUMINATING INDICATOR STRIP

(75) Inventor: Johannes Moritzhuber, Hard (AT)

(73) Assignee: Innova Patent GmbH, Wolfurt (AT)

( * ) Notice: Subject to any disclaimer, the term of this patent is extended or adjusted under 35 U.S.C. 154(b) by 162 days.

(21) Appl. No.: 13/161,017

(22) Filed: Jun. 15, 2011

(65) Prior Publication Data

US 2012/0103226 A1 May 3, 2012

(30) Foreign Application Priority Data

Oct. 28, 2010 (AT) ..... 1789/2010

(51) Int. Cl.
*B61B 12/00* (2006.01)
*G09F 13/04* (2006.01)

(52) U.S. Cl.
USPC ..... 104/173.1; 40/565

(58) Field of Classification Search
USPC ..... 104/89–91, 112–115, 173.1, 173.2; 40/565
See application file for complete search history.

(56) References Cited

U.S. PATENT DOCUMENTS 3,906,439 A * 9/1975 Hopla ..... 340/332
6,231,206 B1 * 5/2001 Hervey et al. ..... 362/153

* cited by examiner

*Primary Examiner* — R. J. McCarry, Jr.
(74) *Attorney, Agent, or Firm* — Laurence A. Greenberg; Werner H. Stemer; Ralph E. Locher

(57) ABSTRACT

A cableway system for conveying skiers from a valley station to a mountain station has a continuous, and continuously moving, conveying cable, which is guided in the terminal stations via deflecting pulleys, of which at least one is a driven head wheel. The system includes chairs with seats for several skiers. The chairs are uncoupled from the conveying cable at the entrance into the stations, and guided through the stations, along guide rails, at a speed which is reduced in relation to the speed of the conveying cable, wherein the skiers sit on these chairs, or disembark therefrom, and the chairs are once more coupled to the conveying cable at the exit of the station. Skier-access barriers, are located in the valley station through which the skiers pass into the region of the movement paths of the chairs. A marking is provided in the region of the movement path of the chairs that indicates to the skiers the necessary positions for sitting on the chairs. The marking here is formed by a plurality of luminaires or luminary groups arranged in the surface of the ground in a direction transverse to the movement direction of the chairs, wherein each of the seats located on the chair is assigned a separate luminaire or luminary group.

7 Claims, 3 Drawing Sheets

CABLEWAY SYSTEM FOR CONVEYING SKIERS AND ILLUMINATING INDICATOR STRIP

CROSS-REFERENCE TO RELATED APPLICATION

This application claims the priority, under 35 U.S.C. §119, of Austrian patent application A 1789/2010, filed Oct. 28, 2010; the prior application is herewith incorporated by reference in its entirety.

BACKGROUND OF THE INVENTION

Field of the Invention

The present invention relates to a cableway system for conveying skiers from a valley station to a mountain station, having an endless, and continuously moving, conveying cable, which is guided in the terminal stations via deflecting pulleys, or head wheels. At least one of the deflecting pulleys is driven. The system has chairs for a number of skiers. The chairs are uncoupled from the conveying cable at the entrance into the stations and guided through the stations, along guide rails, at a speed which is reduced in relation to the speed of the conveying cable. The skiers sit down onto these chairs, or disembark therefrom, and then the chairs are once more coupled to the conveying cable. The system also has skier-access barriers, which are located in the valley station and through which the skiers pass into the region of the movement path of the chairs, and having a marking, which is located in the region of the movement path of the chairs and which indicates to the skiers the necessary positions for sitting on the chairs.

With prior art cableway systems of this type, there is the problem, in the valley station, of the skiers in the movement path of the chairs, rather than always moving up to those positions which are envisaged for them to sit on the chairs, sitting on the chairs before they have reached the positions envisaged for this purpose. Since the chairs are moved over a curved path into the region envisaged for the skiers to sit on them, this results in the relevant skiers getting onto the chairs between two seats, as a result of which the rest of the skiers wanting to sit on the chairs in the positions envisaged for this purpose do not have the necessary seats available to them.

This problem and difficulty is continuously exacerbated as the number of seats on the chairs increases, especially as the chairs for cableway systems may now have up to twelve seats.

In order to avoid this difficulty, it is known, in the movement path of chairs of cableway systems, for those positions up to which the skiers should move in order to sit on a chair to be marked by a colored strip located on the surface of the ground. However, since this marking is often not observed by the skiers, this strip does not meet the existing requirements.

SUMMARY OF THE INVENTION

It is accordingly an object of the invention to provide a cableway system for transporting skiers which overcomes the above-mentioned disadvantages of the heretofore-known devices and methods of this general type and which provides for a configuration with a marking that will be observed more closely by the skiers than has been the case hitherto, in order to avoid the difficulties occurring in the boarding region where the skiers sit down on the chairs.

With the foregoing and other objects in view there is provided, in accordance with the invention, a cableway system for conveying skiers between terminal stations, the system comprising:

a conveying cable extending between the terminal stations and guided via deflecting pulleys in the terminal stations;

a plurality of chairs each having a plurality of seats for accommodating a number of skiers;

wherein the chairs are transported by way of the conveying cable between the terminal stations, are uncoupled from the conveying cable at an entrance into a respective the station, and guided by guide rails through the station along a given movement path at a speed that is reduced in relation to a speed of the conveying cable, enabling the skiers to sit down on the chairs, or disembark therefrom, in the station;

skier-access barriers disposed in one of the terminal stations and selectively enabling the skiers to pass into the movement path of the chairs;

a marking device disposed in a region of the movement path of the chairs for indicating to the skiers respectively required positions for sitting on the chairs, the marking device including a plurality of luminaires or luminary groups arranged in a ground surface and extending transversely to a direction of movement of the chairs, with each of the seats of the chair being assigned a separate luminaire or luminary group.

In other words, the objects of the invention are achieved in that the marking is formed by a plurality of luminaires or luminary groups arranged in the surface of the ground in a direction transverse to the movement direction of the chairs, wherein each of the seats located on the chairs is assigned a separate luminaire or luminary group. The individual luminaires or luminary groups are preferably spaced apart from one another. In addition, the individual luminaires are preferably formed by groups of LED lamps.

According to a further preferred embodiment, the movement paths of the skiers, for the individual seats located on the chairs, are each assigned sensors which determine the position of the skiers, wherein the luminaires or luminary groups in those paths in which the skiers are located in the correct positions for sitting on the chairs are switched off, whereas the luminaires or luminary groups in those movement paths in which the skiers are not located in the correct positions remain switched on.

The luminaires or the luminary groups are preferably located on a strip comprising a base strip with a plurality of luminaires or luminary groups and with a housing fastened on it, wherein the base strip and the housing are produced from a metal, in particular from stainless steel, such as Nirosta® sheet, or from aluminum. According to a preferred embodiment, the strip is designed with a protective covering produced from a plastics material.

Other features which are considered as characteristic for the invention are set forth in the appended claims.

Although the invention is illustrated and described herein as embodied in a cableway system for conveying skiers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
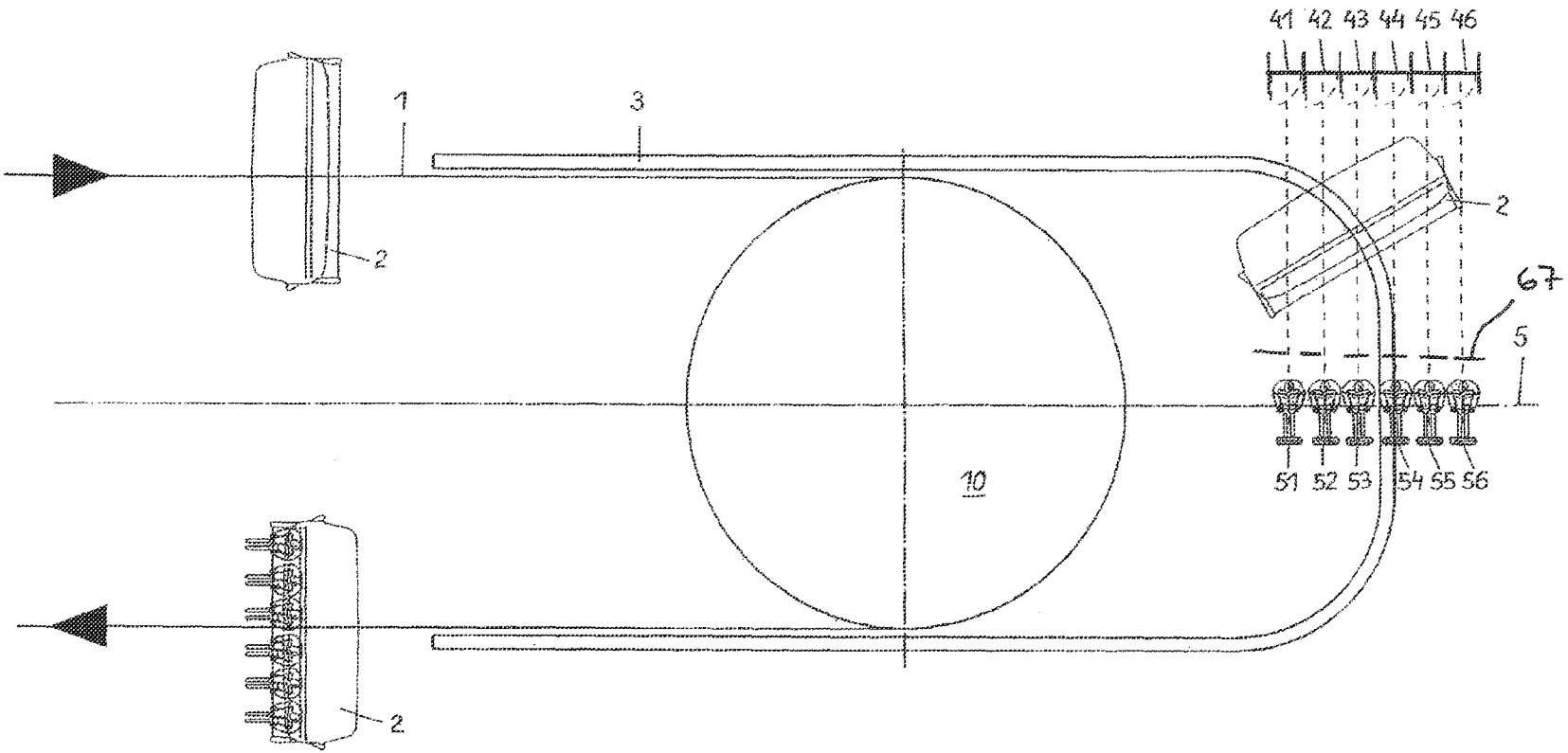
FIG. 1 shows a plan view of the valley station of a cableway system designed with chairs.
Figure 2:
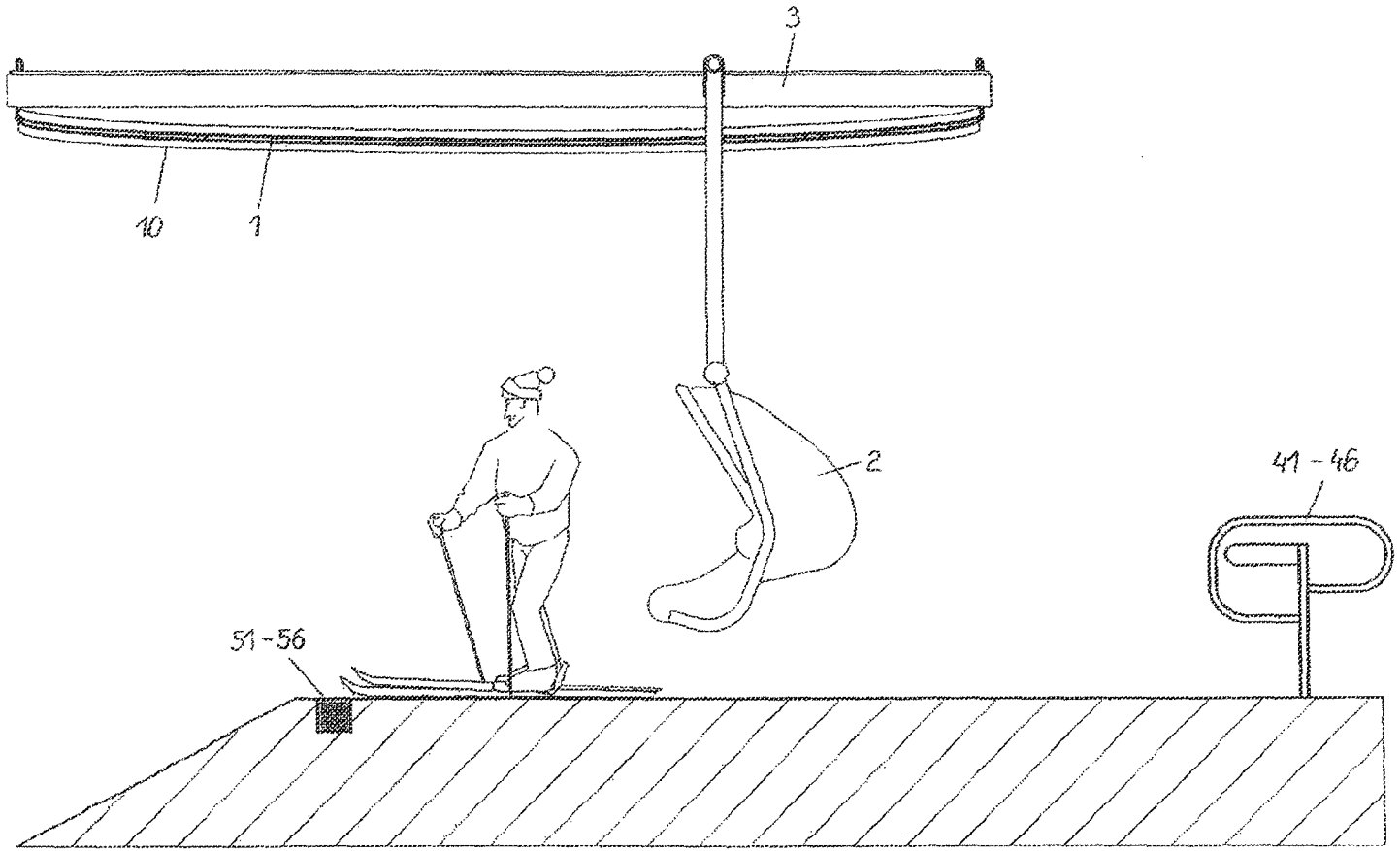
FIG. 2 shows a side view of that region in this valley station where the skiers are intended to sit on the chairs.

Referring now to the figures of the drawing in detail and first, particularly, to FIGS. 1 and 2 thereof, there is shown a conveying cable 1 of a cableway system for transporting skiers between terminal stations. Chairs 2 for skiers are coupled to the conveying cable for this purpose. The chairs 2 are illustrated with six seats. The conveying cable 1, which is moved at a constant speed of, for example, 5 m/sec, is guided in the valley station around a deflecting pulley 10, also referred to as a head wheel 10. At the entrance into the valley station, the chairs 2 are uncoupled from the conveying cable 1 and moved through the valley station, along a guide rail 3, at a speed of, for example, 1 m/sec, which is reduced in relation to the speed of the conveying cable 1. The chairs here are guided through a region in which the skiers sit down onto the chairs 2, i.e., where they embark the transportation device. After loading the skiers, the chairs 2 are then once more coupled to the conveying cable 1, as a result of which the skiers are conveyed to the mountain station.

The skiers gain access to that region in which they sit on the chairs 2 through access barriers 41 to 46 in the form of chutes, which are controlled in dependence on the movement of the chairs 2 in the valley station. As soon as the skiers located in the region for sitting on a chair 2 have been moved away by this chair, the access barriers 41 to 46 are opened, whereupon a further group of skiers, in a number equal to the number of seats on the chairs 2, can move into the embarking region for sitting on the chairs 2.

Since, on the one hand, the movement path of the chairs 2 up to the region where the skiers sit on these chairs is curved and, on the other hand, the movement path of the skiers into this region is rectilinear, there is a need for the skiers to move up to a line 5 in which the movement path of the chairs 2 is no longer curved, since only then are the skiers located in those positions in which they will sit onto the associated seat on the chair 2.

In order for these positions to be indicated in a manner which is clearly discernible to the skiers, this line is formed by individual luminaires or luminary groups 51 to 56, which are located one beside the other and are spaced apart from one another, wherein one luminaire 51 to 56 is located in each movement path of the individual skiers. These luminaires 51 to 56 prompt the skiers to move up to the luminaires 51 to 56, as a result of which they assume the positions necessary for sitting on the chairs 2 correctly.

The luminaires or luminary groups 51 to 56 are preferably switched on synchronously with the opening of the access barriers 41 to 46 and remain switched on until the relevant skiers have assumed the correct positions for sitting on the chair 2. The assumption of the correct position is determined by sensors 67 that are assigned to the movement paths of the skiers. The sensors 67 are indicated in a highly schematic fashion in FIG. 1. Any of a variety of sensor types may be used in this context.

It is also possible here for the luminaires 51 to 56 to be designed as flashing luminaires. Furthermore, the luminaires 51 to 56 may be designed as colored luminaires, for instance, red suggesting an incorrect position and green indicating that the respective skier has reached the proper position from which he/she may sit down onto the moving chair. According to one preferred embodiment, the luminaires 51 to 56 are formed by groups of LED luminaires.

Figure 3:
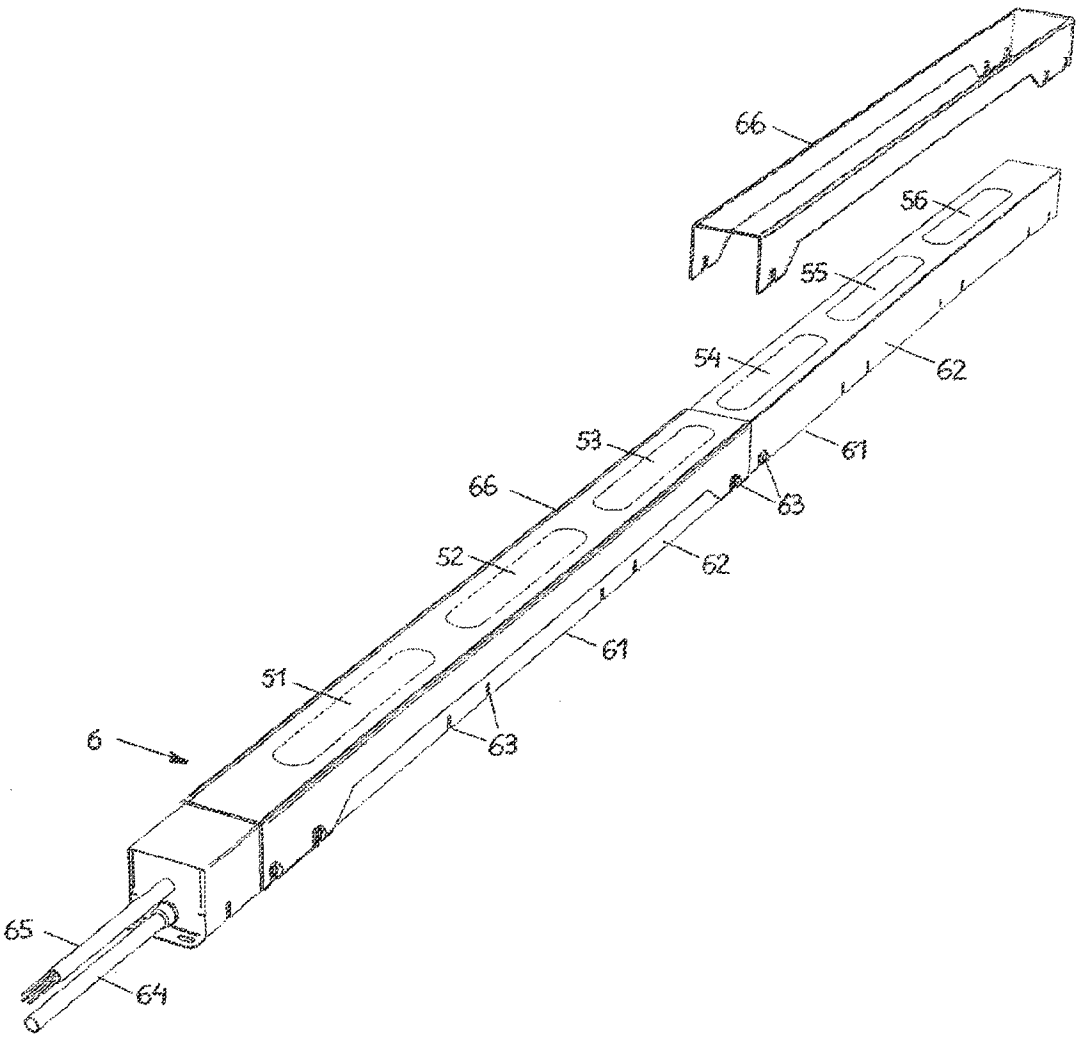
FIG. 3 shows an axonometric illustration, partly in exploded form, of a strip according to the invention formed with luminaires or luminary groups.

Referring now to FIG. 3, there is illustrated a strip 6 which has six luminary groups 51 to 56. This strip 6 comprises a base 61, on which there are located six luminary groups 51 to 56, which are enclosed by a housing 62. The base 61 and the housing 62 are produced from stainless sheet steel, such as Nirosta® steel sheets or from aluminum. The individual luminary groups 51 to 56 each comprise six LED luminaires. On its upper side, the housing 62 is formed with apertures, which are assigned to the luminary groups 51 to 56 and through which the luminaires or luminary groups 51 to 56 are visible. The housing 62 is fastened on the base 61 by way of screws 63. Furthermore, the strip 6, at least on one of its two end surfaces, is designed with a tube 64 for the outflow of condensation. In addition, the strip 6, on one of the two end surfaces, is designed with a connection cable 65, which contains the necessary power lines and, possibly, control lines for the LED luminaires.

Since there is a high level of frictional resistance between the steel edges of the skis and the housing 62, which is produced from metal—damage the structures may result—the housing 62 is formed with a transparent or translucent covering 66, which is produced from plastics material and has a very low coefficient of friction in relation to metallic ski edges. This covering 66 protects the housing 62 in relation to mechanical damage and in relation to the ingress of water into the interior of the housing 62. Since this covering 66 is inexpensive to produce, and is positioned on the housing 62 in an easily exchangeable manner, it can always be replaced by a new covering 66 if it becomes damaged or worn.

The invention claimed is:

1. A cableway system for conveying skiers between terminal stations, the system comprising:

a conveying cable extending between the terminal stations and guided via deflecting pulleys in the terminal stations;

a plurality of chairs each having a plurality of seats for accommodating a number of skiers;

wherein said chairs are transported by way of said conveying cable between the terminal stations, are uncoupled from said conveying cable at an entrance into a respective said station, and guided by guide rails through said station along a given movement path at a speed that is reduced in relation to a speed of said conveying cable, enabling the skiers to sit down on the chairs, or disembark therefrom, in said station;

skier-access barriers disposed in one of said terminal stations and selectively enabling the skiers to pass into the movement path of said chairs;

a marking device disposed in a region of the movement path of said chairs for indicating to the skiers respectively required positions for sitting on said chairs, said marking device including a strip with LED luminaires or LED luminary groups arranged in a ground surface in the boarding region of the cableway system and extending transversely to a direction of movement of said chairs, said strip having a base strip with a plurality of LED luminaires or LED luminary groups and a housing fastened thereon, with each of said seats of said chair being assigned a separate LED luminary group.

2. The cableway system according to claim 1, wherein said individual luminaires or luminary groups are spaced apart from one another.

3. The cableway system according to claim 1, which comprises a plurality of sensors disposed to monitor the movement paths of the skiers aligned with the individual said seats on said chairs, said sensors determining respective positions of the skiers, and wherein said luminaires or luminary groups in those paths in which the skiers are located in correct positions for sitting on the respective said chair are switched off, whereas said luminaires or luminary groups in those movement paths in which the skiers are not located in the correct positions remain energized.

4. The cableway system according to claim 1, wherein said base strip and said housing are formed of metal.

5. The cableway system according to claim 4, wherein said base strip and said housing are formed of a metal selected from the group consisting of stainless steel and aluminum.

6. The cableway system according to claim 4, wherein said base strip and said housing are formed of a Nirosta® sheet or of aluminum.

7. The cableway system according to claim 4, which comprises a protective covering produced from a plastics material.

* * * * *